US009343005B2

(12) United States Patent
Suciu et al.

(10) Patent No.: US 9,343,005 B2
(45) Date of Patent: May 17, 2016

(54) EXTRUDED FRAME TRIM ARRANGEMENT

(71) Applicants: Rebecca C. Suciu, Lynn, MA (US); Thomas P. Burrous, Haverhill, MA (US); Erik G. Zelbacher, Lynn, MA (US); Alan L. Stenfors, Scituate, MA (US); Paul E. Ellsworth, Burlington, MA (US); Sidney Rose, Marblehead, MA (US)

(72) Inventors: Rebecca C. Suciu, Lynn, MA (US); Thomas P. Burrous, Haverhill, MA (US); Erik G. Zelbacher, Lynn, MA (US); Alan L. Stenfors, Scituate, MA (US); Paul E. Ellsworth, Burlington, MA (US); Sidney Rose, Marblehead, MA (US)

(73) Assignee: Rose Displays, Ltd, Salem, MA (US)

( * ) Notice: Subject to any disclaimer, the term of this patent is extended or adjusted under 35 U.S.C. 154(b) by 37 days.

(21) Appl. No.: 13/999,712

(22) Filed: Mar. 17, 2014

(65) Prior Publication Data

US 2015/0262519 A1 Sep. 17, 2015

(51) Int. Cl.
*A47G 1/06* (2006.01)
*G09F 15/00* (2006.01)

(52) U.S. Cl.
CPC ..... *G09F 15/0025* (2013.01)

(58) Field of Classification Search
USPC ..... 40/777, 781, 782, 603; 38/102.1, 38/102.91
See application file for complete search history.

(56) References Cited

U.S. PATENT DOCUMENTS

| | | | | |
|---|---|---|---|---|
| 3,885,335 A * | 5/1975 | Egermayer | ..... | 40/603 |
| 5,007,188 A * | 4/1991 | Feist | ..... | 40/782 |
| 2007/0240348 A1* | 10/2007 | Rubin | ..... | 40/603 |

* cited by examiner

*Primary Examiner* — Joanne Silbermann
(74) *Attorney, Agent, or Firm* — Don Halgren

(57) ABSTRACT

An extrusion member for assembly into a display fabric supporting frame arrangement for enabling the assembly and display of a flexible fabric therewithin. The extrusion member comprises an elongated outer segment for enabling the support of a frameless flexible display in a frame arrangement, and an elongated inner segment for enabling the support of a frameless flexible display in a frame arrangement, wherein either segment or the inner segment, or both the outer segment and the inner segment may peripherally support a flexible display on a common extrusion member assembly.

8 Claims, 9 Drawing Sheets

EXTRUDED FRAME TRIM ARRANGEMENT

BACKGROUND OF THE INVENTION

1. Field of the Invention

This invention relates to elongated extrusions and more particularly to extrusions which are adaptable to form a trim member for inclusion into an assembled display frame in which one or more flexible display members are readily attached to and removed from a one or two sided display arrangement comprised of the assembled display frame.

2. Discussion of the Art

There is a need in the business community for the display of advertisements in an efficient and inexpensive manner. One way to do this is by the use of flexible material such as for example, a fabric or cloth, which heretofore has been utilized primarily, for example, as awnings with a display printed/painted thereon. Such a fabric or cloth display has the advantages that it may be easily produced, changed, transported, stored and easily adapted to different size and shape supports, for indoor or outdoor displays.

It is an object of the present invention to provide a novel support arrangement which utilizes those advantages in a manner not shown in the art.

It is another object of the present invention to provide a novel support arrangement which may be easily assembled, transported, adapted to different sizes, lengths, and shapes.

It is a further object of the present invention provide a novel frame support which will accommodate fabrics or other flexible materials in either a one or two sided manner, as desired, which manner is not shown in the art.

BRIEF SUMMARY OF THE INVENTION

The present invention comprises a rectilinear assembly of elongated frame trim members attachable together to form a perimeter securing support frame assembly for one flexible fabric display panel on one side thereof, or two flexible fabric display panels, one on each side of that frame assembly.

The flexible fabric display panels to be utilized with this frame assembly have a perimeter with a bead secured therearound. The peripheral bead and its utilization will be described in greater detail hereinbelow.

Each elongated frame trim member making up the frame assembly comprises an elongated extrusion having an elongated outer segment and an elongated, parallel inner segment thereto. The outer segment has on its outermost peripheral surface, an elongated outer cover member having a first elongated very narrow edge on one side thereof and an exposed frame face contiguous thereto and formed contiguous therewith in an L-shaped manner from a second elongated edge on the other side edge thereof. The frame face as an inner side thereto which has an elongated shelf projection thereon, which shelf projection lies in a plane parallel to the outermost peripheral segment. The space between the outermost peripheral surface and the elongated shelf projection thereon defines an elongated slot for receipt of a peripheral bead of the fabric supported thereby. The elongated shelf projection has a first channel flange on its side opposite the slot.

The frame face has a lower corner or second edge which meets and defines a connecting bridge between the inner segment of the elongated frame member. The connecting bridge has a second channel flange thereon which it faces and is of corresponding size and is in parallel alignment with the first channel flange on the elongated shelf projection. The first channel flange and the second channel flange define a narrow, elongated space between one another and the inner surface of the frame face of the outer segment for receiving the insertion of a frame member connector to be described hereinbelow.

The inner segment of the elongated frame member includes an elongated coverable frame face which is contiguous to and perpendicular to the connecting bridge. The coverable frame face has an inner side on which a further elongated shelf projection extends their perpendicularly therefrom. The further elongated inner segment shelf projection is parallel to the connecting bridge and between them defines a slot for receiving an elongated bead edge of a further fabric display for the other side of the elongated frame assembly arrangement.

The elongated covered frame face of the inner segment has a lower edge of "J" shape. The elongated shelf projection extending from the inner side of the covered frame face has an elongated channel flange thereon, which is in line, correspondingly sized to, and parallel with the "J" shaped flange on the lower end of the covered frame face. The channel between the two opposed the elongated flanges defines another receiving slot for another elongated frame member connector, enabling any two respective elongated frame members to be joined longitudinally together, or at an angle, (with the appropriate angle cut at the respective ends of the particular elongated frame member).

The connector members, two arranged at each end of each respective elongated frame member may be of "L" shape so as to create a corner, or the connectors may be straight so as to join contiguous elongated frame member in a linear manner for an extended length/width frame assembly.

The frame members, when joined together so as to form a rectilinear frame assembly, enable the presentation of flexible displays from both a first or "frameless" side and/or a second or "framed" side.

The "frameless" presentation of a flexible fabric is effect when the peripheral bead of that flexible fabric is received/stuffed within the graphics bead receiving slot between the outer elongated cover and the projections extending from the inner surface of the exposed frame face on the outer segment of the respective frame members. That "frameless" presentation exposes only a very narrow peripheral visible edge on the first side of the outer segment elongated frame member cover portion.

The framed presentation of a fabric display is effected when the peripheral bead of that piece of flexible fabric is stuffed/inserted within the receiving slot between the connecting bridge and the elongated shelf extending inwardly from the inner segment of the covered frame assembly. The framed portion comprises the "exposed" frame face displayed in a plane which is in co-alignment with the plane of the "framed" fabric display.

Thus an assembled rectilinear frame member arrangement enables a display of a fabric display on a first or frameless side thereof, and display a second fabric display on a second side of that frame assembly. Such a display could be done against a wall, utilizing either one of those frame fabric displays arranged within its particular graphic slot configuration. Such an assembled rectilinear frame member arrangement (or other geometric shape) may be supported on a support or hung from an overhead, as appropriate.

The invention thus comprises an extrusion member for assembly into a display fabric supporting frame arrangement for enabling the assembly and display of a flexible fabric therewithin, comprising an elongated outer segment for enabling the support of a frameless flexible display in a frame arrangement, an elongated inner segment for enabling the support of a frameless flexible display in a frame arrangement, wherein either segment or the inner segment, or both the outer segment and the inner segment may peripherally support a flexible display on a common extrusion member assembly. The outer segment has an exposed frame face on one side thereof. The inner segment has a coverable frame face on one side thereof. The frame face on the outer segment displays only a visible narrow frame edge when a flexible, beaded graphic display is received therewith. The outer segment may include a bead receiving slot on one side thereof. The inner segment may include a bead receiving slot on the side opposite bead receiving slot on the outer segment.

A connecting bridge connects the outer segment to the inner segment. A projecting shelf which extends off of an inner side of the exposed frame face, and is arranged to define a bead receiving slot between the projecting shelf and an outer cover member of the extrusion member. A downwardly extending first channel flange extends downwardly from the projecting shelf of the outer segment. An upwardly extending second channel flange extends upwardly from the connecting bridge between the outer segment and the inner segment, the first channel flange and the second channel flange being in alignment with one another to define a connector receiving slot therebetween. The extrusion member including a downwardly extending fourth channel flange extending downwardly from the projecting shelf extending off of the inner segment and an upwardly extending "J" shaped flange extending from a lower edge of the inner segment, to define a connector receiving slot therebetween.

The invention also comprises a connected assembly of extruded members wherein each member has an outer segment and an inner segment parallel to one another, and wherein the outer segment has a graphic display bead receiving slot therein on a first side of the assembly, wherein the inner segment has a graphic display bead receiving slot on a second side of the assembly, wherein a graphic display received within the bead receiving slot on the inner segment thereof enables a flexible frameless graphic display to be presented on that second side. The inner segment has a graphic display bead receiving slot on a first side of the assembly, wherein a graphic display received within the bead receiving slot on the outer segment thereof enables a flexible framed graphic display to be presented on that first side.

The invention also comprises a frame assembly for enabling the two sided display of a flexible display graphic on either/both side(s) of the frame assembly, or on one side of the frame assembly, the frame assembly comprising a connected array of extrusion members, wherein each extrusion member comprises an elongated outer segment for enabling the support of a frameless flexible display in a frame arrangement, and an elongated inner segment for enabling the support of a frameless flexible display in a frame arrangement, wherein either segment or the inner segment, or both the outer segment and the inner segment may peripherally support a flexible display on a common extrusion member assembly. The outer segment may have an exposed frame face on one side thereof, and a frameless display on the other side thereof, when the outer segment contains a graphic display disposed therewithin. The inner segment has a coverable frame face on one side thereof.

BRIEF DESCRIPTION OF THE DRAWINGS

The objects and advantages of the present invention will become more apparent, when viewed in conjunction with the following drawings in which.

DETAILED DESCRIPTION OF THE PREFERRED EMBODIMENTS

Figure 1:
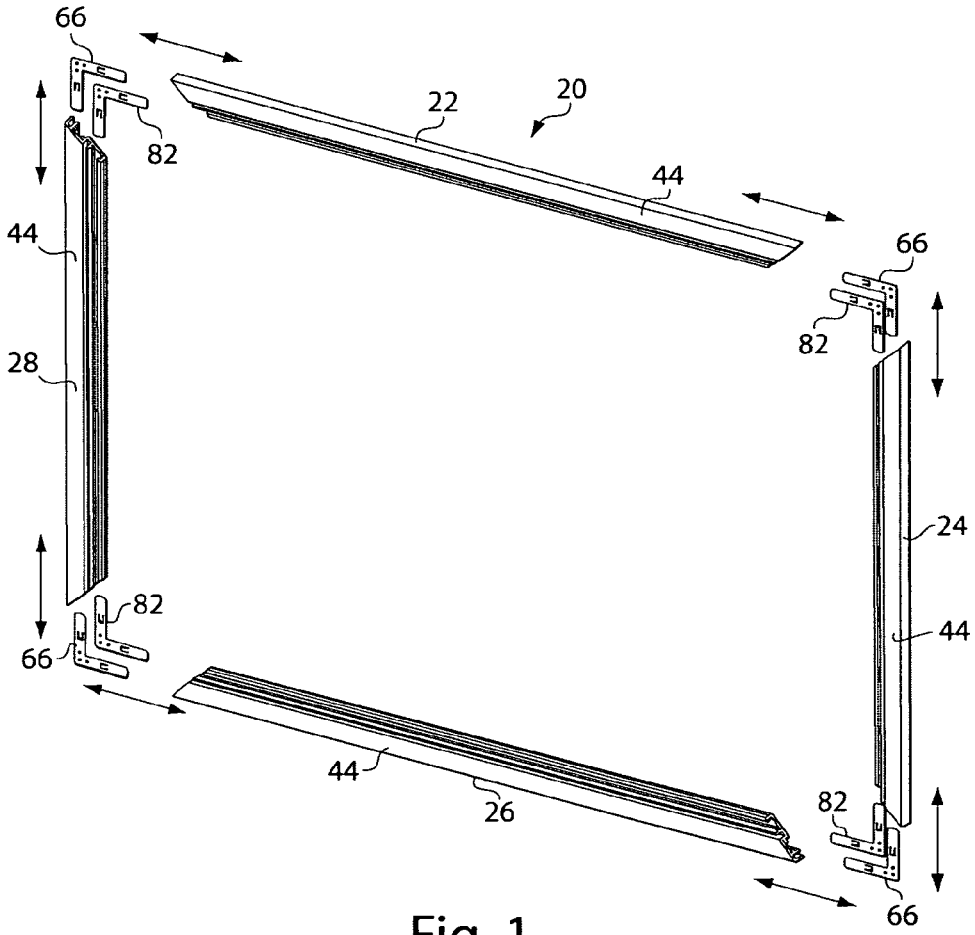
FIG. 1 is a perspective view and also as an exploded view of a frame assembly arrangement constructed according to the principles of the present invention.
Figure 3:
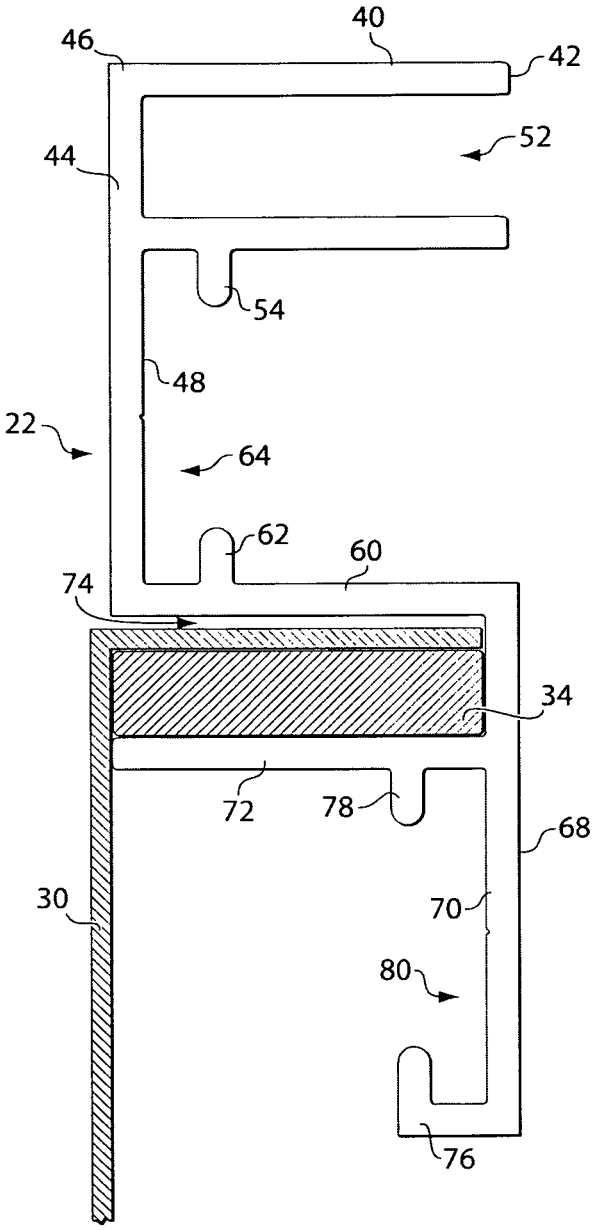
FIG. 3 is an end view of an elongated frame trim member similar to FIG. 2 showing a flexible graphic display supported by a graphic display support slot for a "framed" display thereof.
Figure 4:
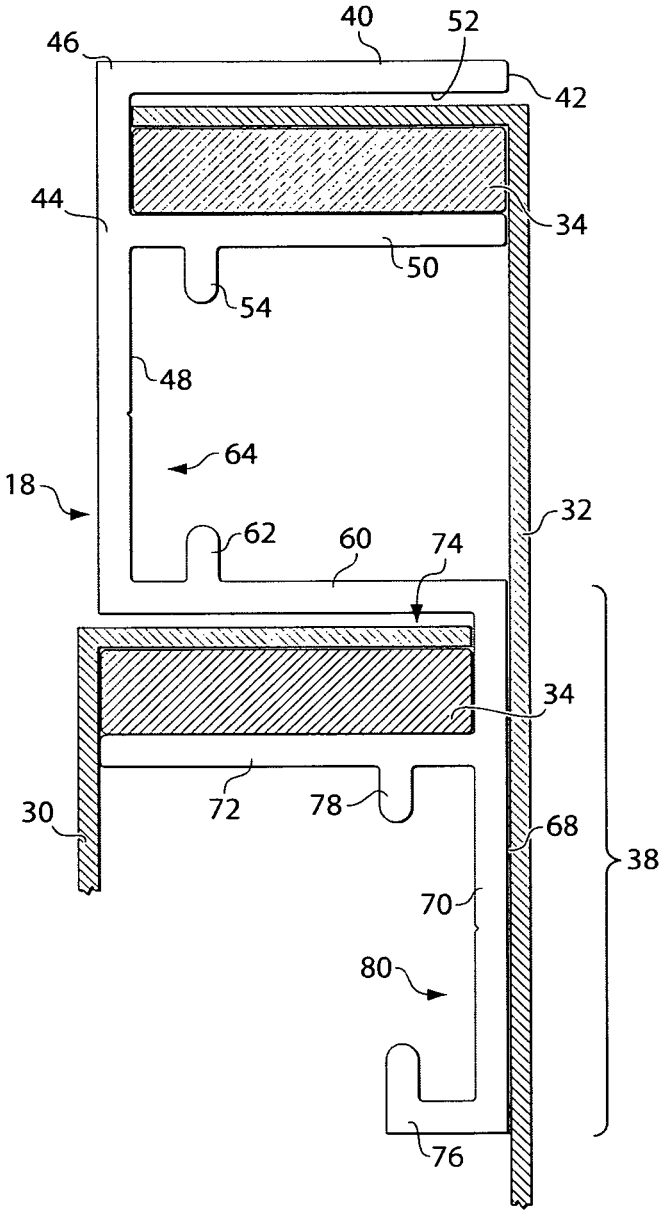
FIG. 4 is a view of an elongated frame trim member similar to FIG. 3 also showing a flexible graphic display supported by a graphic display support slot for an "unframed" display thereof on an outer segment side of the frame assembly, and also showing a "framed" graphic display on an inner segment of the framed assembly arrangement.
Figure 9:
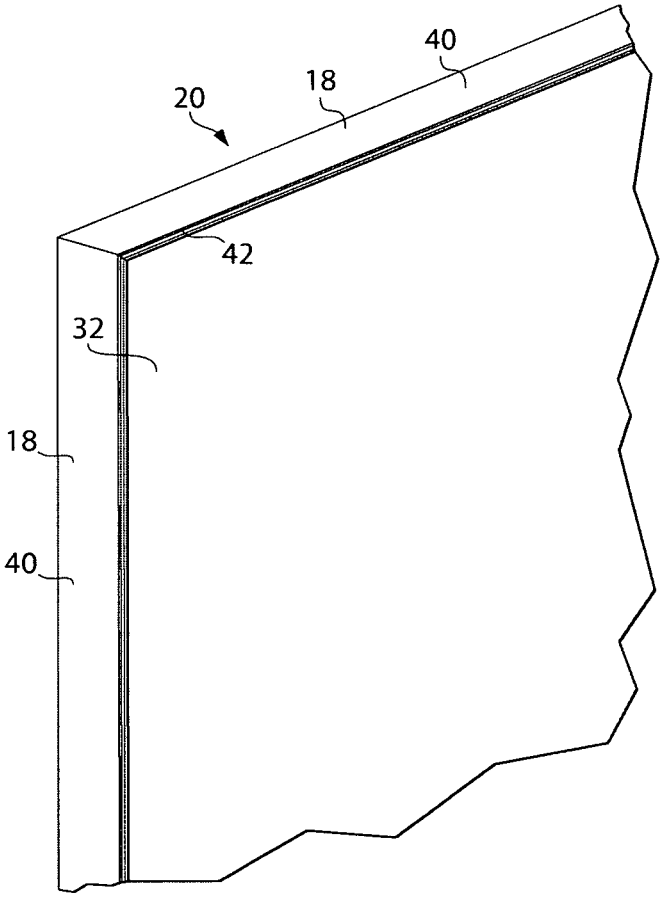
FIG. 9 is an enlarged perspective view of a corner of a frame assembly with a fabric display disposed therein in its "unframed" presentation, that is, without its outer segment frame face being exposed or shown.

Referring not to the drawings in detail, and particularly to FIG. 1, there is shown the present invention which comprises a rectilinear assembly of elongated frame trim members 22, 24, 26 and 28 attachable together to form a perimeter securing support frame assembly 20 for one flexible fabric display panel 30 on one side thereof as represented in FIG. 3, or two flexible fabric display panels 30 and 32, one on each side of that frame assembly 20, as represented in FIG. 4, and as shown in a "frameless" perspective representation, in FIG. 9.

The flexible fabric display panels 30 to be utilized with this frame assembly 20 have a perimeter with a peripheral slot-filling bead 34 secured therearound, as shown in section in FIGS. 3 and 4. The peripheral bead 34 and its flexible fabric 30 and 32 and their utilization will be described in greater detail hereinbelow.

Figure 2:
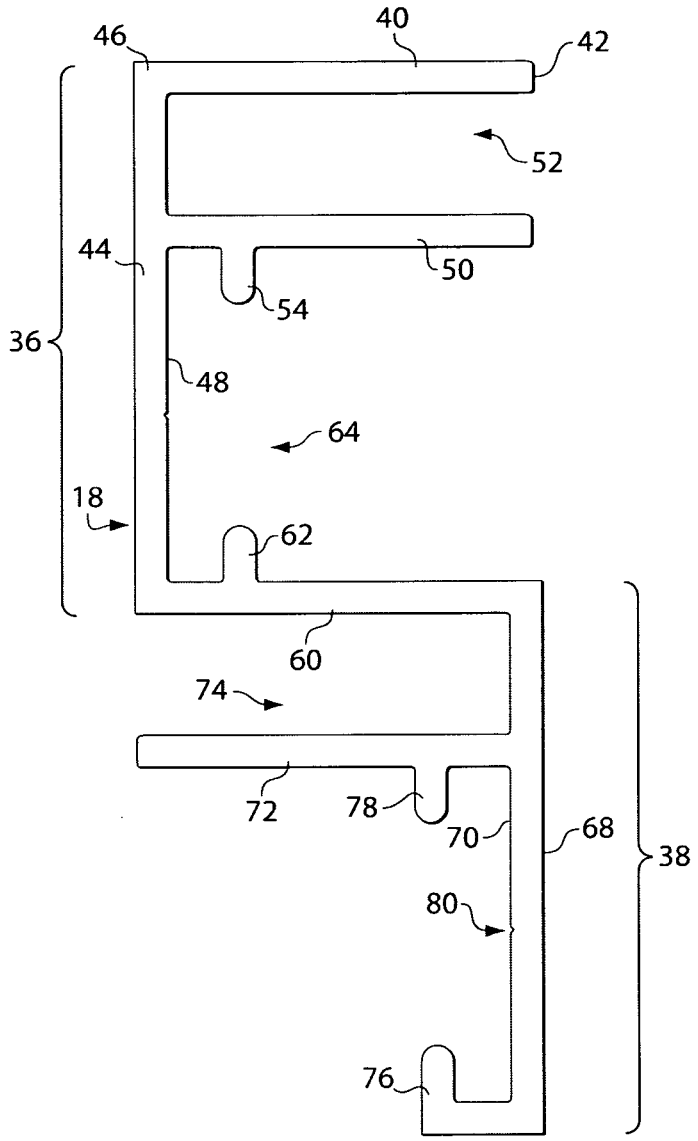
FIG. 2 is an end view of one of the elongated frame trim members, without any display panel fabric, which frame trim member is constructed according to the principles of the present invention.

Each elongated assembled frame trim member 22, 24, 26 and 28, (for a rectilinear arrangement) making up the frame assembly 20 comprises an elongated extrusion 18 having an elongated outer segment 36 and an elongated, parallel inner segment 38 therewith, as represented in FIG. 2. The outer segment 36 has on its outermost peripheral surface, an elongated outer cover member 40 having a first elongated very narrow side-edge 42 on one side thereof and an "exposed" frame face 44 contiguous thereto and formed contiguous therewith in an L-shaped manner from a second elongated edge 46 on the other side edge thereof, as may be seen in FIG. 2. The exposed frame face 44 has an inner side 48 thereto which has an elongated shelf projection 50 perpendicularly thereon, which shelf projection 50 lies in a plane parallel to the outermost peripheral segment 40, as may be seen in FIGS. 2, 3, 4 and 5. The space between the outermost peripheral surface and the elongated shelf projection 50 thereon defines an elongated bead-receiving slot 52 for receipt of a peripheral bead 34 of the fabric 32, supported thereby, as represented in FIG. 4. The shelf elongated projection 50 has a downwardly extending first channel flange 54 on its side opposite the slot 52, as represented in FIGS. 2, 3, 4, 5 and 6.

Figure 5:
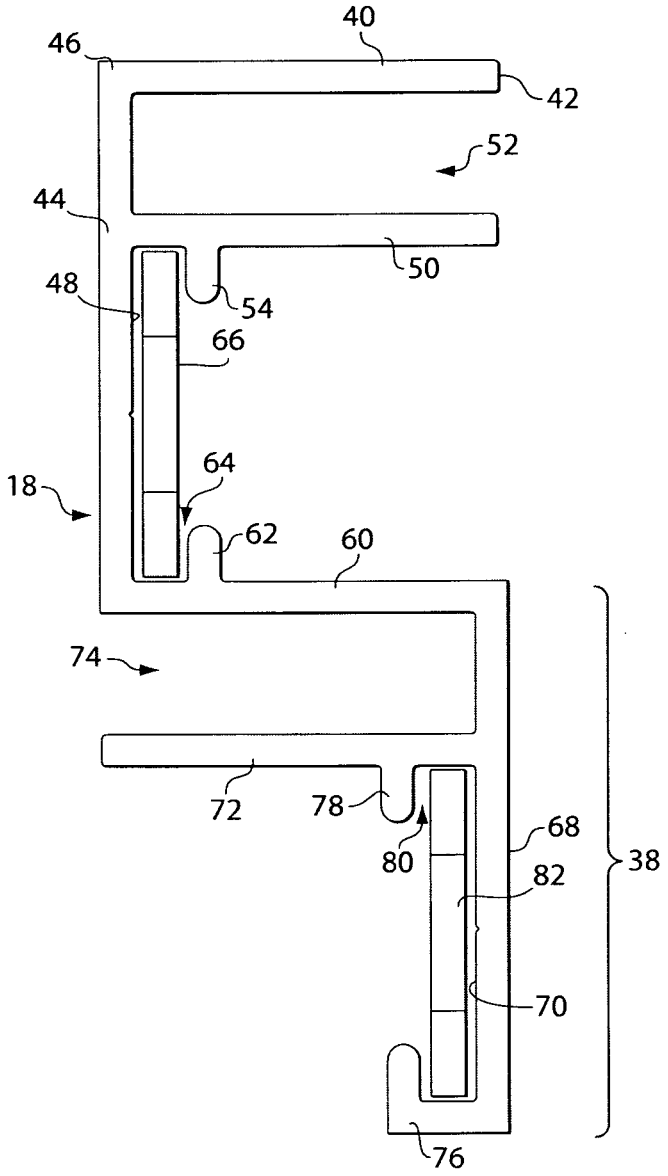
FIG. 5 is an end view of the elongated frame trim member with a connector shown in each of the respective connector receiving slots.
Figure 6:
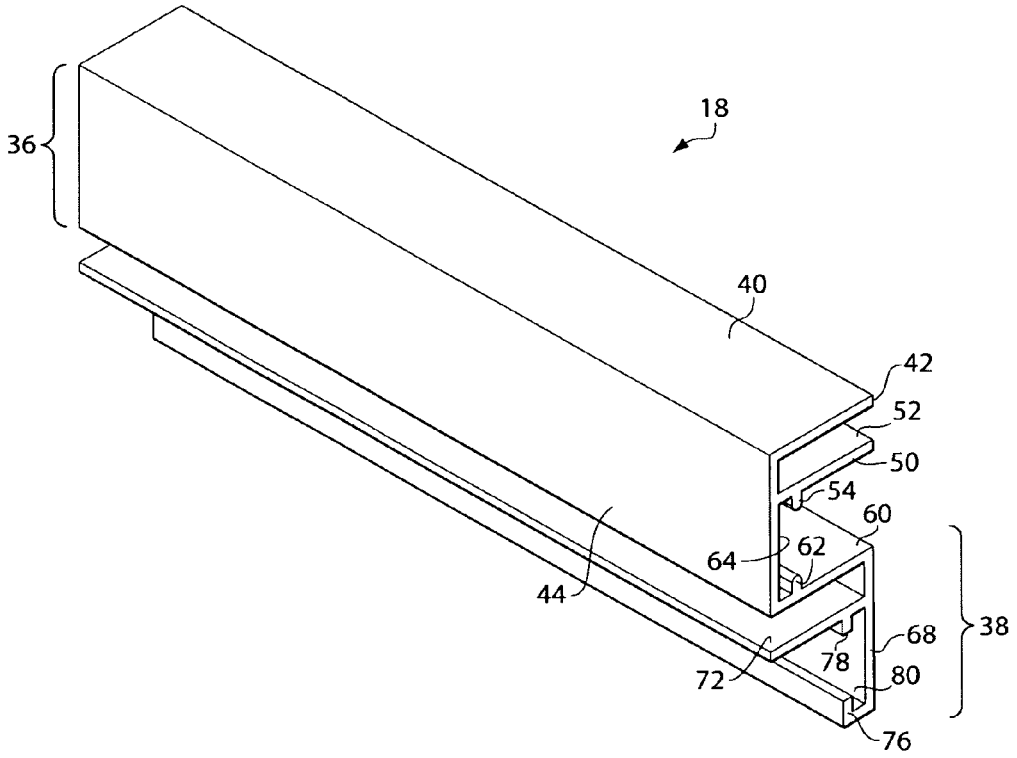
FIG. 6 is a perspective view of an elongated frame trim member shown in FIG. 2.
Figure 7:
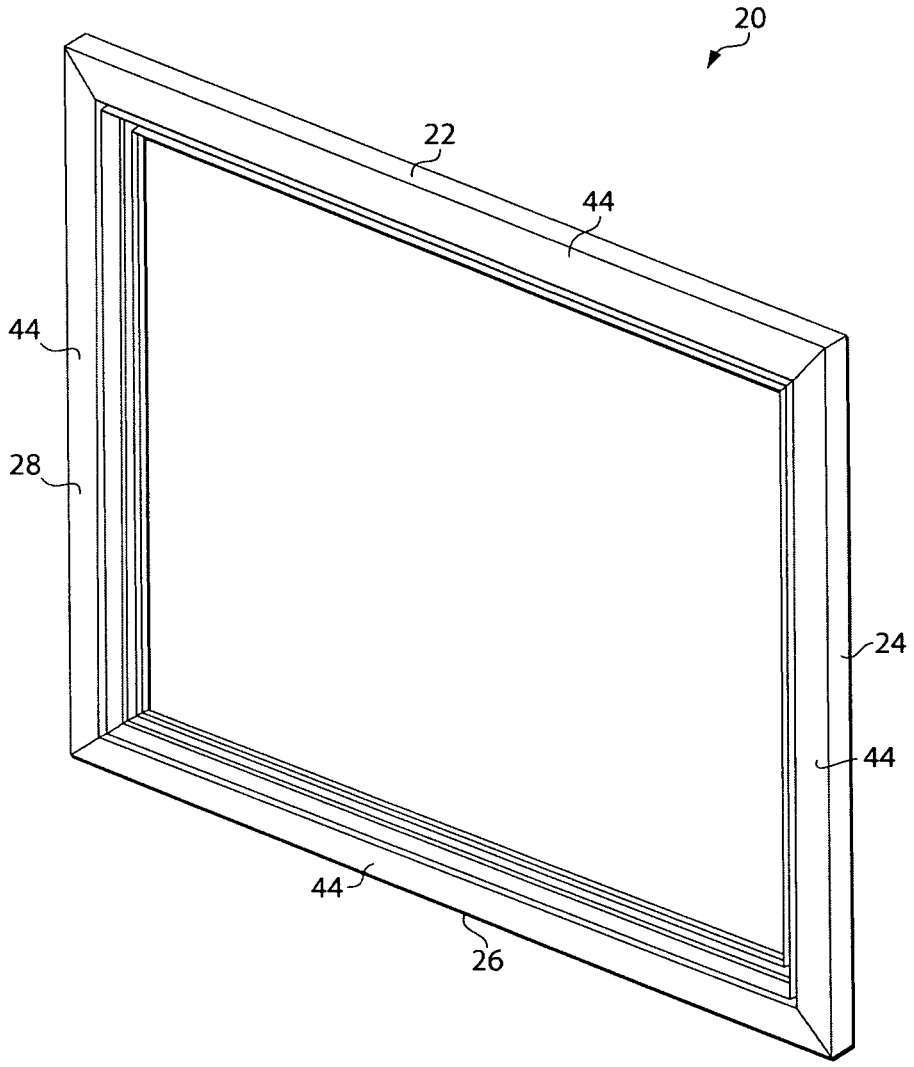
FIG. 7 is a perspective view of a frame assembly, from the "framed" side, without any graphic display arranged therein.
Figure 8:
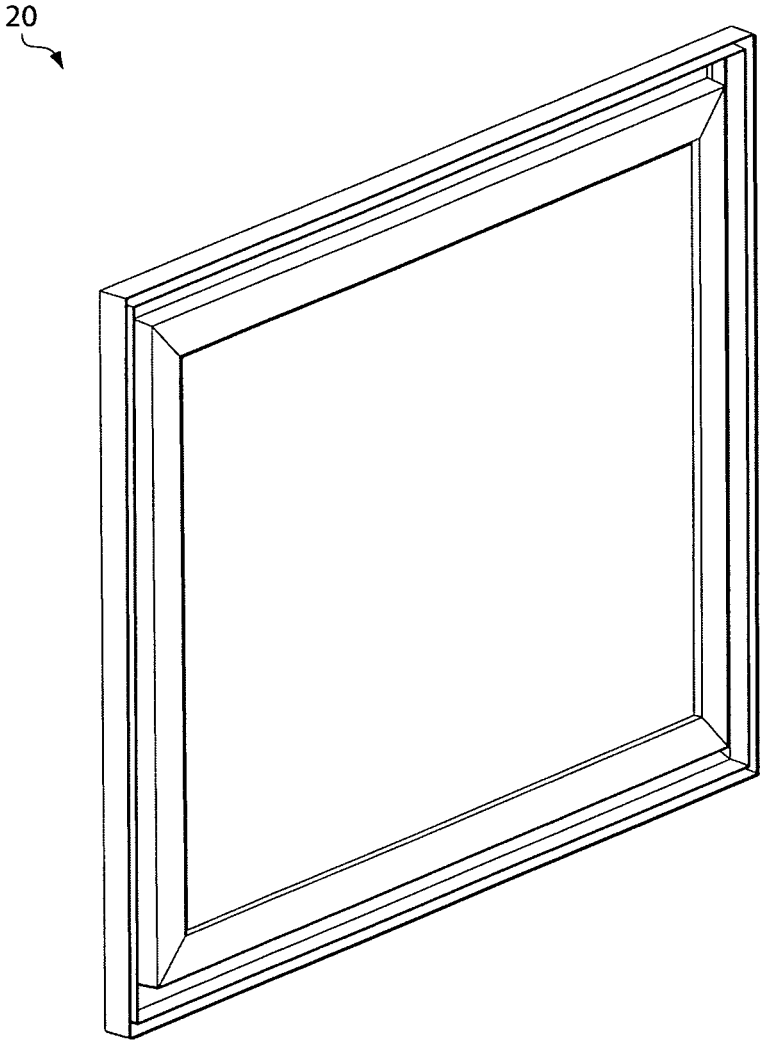
FIG. 8 is a perspective view of the frame assembly shown in FIG. 7, from its other "unframed" side thereof, without any graphic display arranged therein.

The frame face 44 on the outer segment 36 has a lower corner or second edge 56 which meets and defines a connecting bridge 60 to the inner segment 38 of the elongated frame member 18, as may be seen in FIGS. 2 through 6. The connecting bridge 60 has an upwardly extending second channel flange 62 thereon which it faces and is of corresponding size and is in parallel alignment with the first channel flange 54 on the elongated shelf projection 50 on the outer segment 36. The first channel flange 54 and the second channel flange 62 define a narrow, elongated space 64 between one another and the inner surface 48 of the frame face 44 of the outer segment 36, for receiving the insertion of a frame member connector 66, as shown in FIGS. 1 and 5.

The inner segment 38 of the elongated frame member 18 includes an elongated "coverable" frame face 68 which is contiguous to and perpendicular to the connecting bridge 60, which frame face 68 is shown "covered" by display fabric 32, in FIG. 4, the only portion of the frame assembly 20 being visible being the very narrow side-edge 42 of the outer member 40, as also shown in FIG. 9. The coverable frame face 68 has an inner side 70 on which a further elongated shelf projection 72 extends their perpendicularly therefrom, as shown in FIGS. 2, 3, 4, 5 and 6. The further elongated inner shelf segment projection 72 is parallel to the connecting bridge 60 and between them defines a graphic slot 74 for receiving an elongated bead edge 34 of a further fabric display 30 for the other side of the elongated frame assembly arrangement 20, as shown draped against an extrusion member 18, in FIG. 4.

The elongated "covered or coverable" frame face 68 of the inner segment 38 has an upwardly extending flange 76 of "J" shape. The elongated shelf projection 72 extending from the inner side 70 of the covered/coverable frame face 68 has an elongated downwardly extending fourth channel flange 78 thereon, which is in line, correspondingly sized to, and parallel with the upwardly extending "J" shaped flange 76 on the lower end of the covered frame face 68, as represented in FIGS. 2, 3, 4, 5 and 6. The channel between the two opposed the elongated flanges 76 and 78 defines a second receiving slot 80, as represented in FIGS. 2, 3, 4, 5 and 6, for another elongated frame member connector 82, as represented in FIGS. 1 and 5, enabling any two respective elongated frame members 22, 24, 26 and 28, to be joined longitudinally together, or at an angle, (with the appropriate angle cut at the respective ends of the particular elongated frame member) as represented in FIG. 1, for a rectilinear frame assembly.

The connector members 66 and 82, two arranged at each end of each respective elongated frame member may be of "L" shape so as to create a corner as shown in FIG. 1, or the connectors may be straight so as to join contiguous elongated frame member in a linear manner for an extended length/width frame assembly.

The frame members, when joined together so as to form a rectilinear frame assembly, enable the presentation of flexible display from a first or "framed" side as represented in FIG. 3 and/or a second or "framed" and "frameless" side as represented in FIG. 4, exposing only the very narrow side-edge 42.

The "frameless" presentation of a flexible fabric is effect when the peripheral bead 34 of that flexible display fabric 32 is received/pressed within the graphics bead receiving slot 52 between the outer elongated cover 40 and the projection shelf 50 extending from the inner surface 48 of the exposed frame face 44 on the outer segment 36 of the respective frame members 18. That "frameless" presentation exposes only a narrow peripheral visible very narrow side-edge 42 on the first side of the outer segment elongated frame member cover portion 40 as may be seen when looking at the frame member 18 from the right hand side of FIG. 4, and as seen when viewing FIG. 9.

The "framed" presentation of a fabric display 30 is effected when the peripheral bead 34 of that piece of flexible fabric display 30 is stuffed/inserted within the graphics slot 74 between the connecting bridge 60 and the elongated shelf 72 extending inwardly from the inner segment 38 of the covered frame assembly 20, as may be seen if viewing the frame assembly 20, from the left hand side as may be evident in FIG. 3. The framed portion comprises the "exposed" frame face 44 displayed in a plane which is in co-alignment with the plane of the "framed" fabric display 30, represented in FIG. 3

Thus an assembled rectilinear frame member arrangement 20 may display a fabric display 32 on a first or frameless side thereof, and display a second fabric display 30 on a second side of that frame assembly 20. Such a display could be done against a wall, utilizing either one of those frame fabric displays 30 and 32 arranged within its particular graphic slot configuration 74 and 52. Such an assembled rectilinear frame member arrangement 20 (or other geometric shape) may be supported on a support or hung from an overhead, as appropriate.

We claim:

1. An extrusion member for assembly into a display fabric supporting frame arrangement for enabling the assembly and display of a flexible fabric therewithin, comprising:

an elongated outer segment for enabling the support of a frameless flexible display in a frame arrangement;

an elongated inner segment for enabling the support of a frameless flexible display in a frame arrangement, wherein either segment or the inner segment, or both the outer segment and the inner segment may peripherally support a flexible display on a common extrusion member assembly, and wherein the outer segment has an exposed frame face on one side thereof, and a projecting shelf which extends off of an inner side of the exposed frame face to define a bead receiving slot between the projecting shelf and an outer cover member of the extrusion member, and a downwardly extending fourth channel flange extending downwardly from a projecting shelf extending off of the inner segment and an upwardly extending "J" shaped flange extending from a lower edge of the inner segment, to define a second connector receiving slot therebetween.

2. The extrusion member for assembly into a display fabric supporting frame arrangement as recited in claim 1, wherein the inner segment has a coverable frame face on one side thereof.

3. The extrusion member for assembly into a display fabric supporting frame arrangement as recited in claim 2, wherein the frame face on the outer segment displays only a visible very narrow frame edge when a flexible, beaded graphic display is received therewith.

4. The extrusion member for assembly into a display fabric supporting frame arrangement as recited in claim 1, wherein the outer segment includes a bead receiving slot on one side thereof.

5. The extrusion member for assembly into a display fabric supporting frame arrangement as recited in claim 4, wherein the inner segment includes a bead receiving slot on the side opposite bead receiving slot on the outer segment.

6. The extrusion member for assembly into a display fabric supporting frame arrangement as recited in claim 1, wherein a connecting bridge connects the outer segment to the inner segment.

7. The extrusion member for assembly into a display fabric supporting frame arrangement as recited in claim 1, including a downwardly extending first channel flange extending downwardly from the projecting shelf of the outer segment.

8. The extrusion member for assembly into a display fabric supporting frame arrangement as recited in claim 7, including an upwardly extending second channel flange extending upwardly from a connecting bridge arranged between the outer segment and the inner segment, the first channel flange and the second channel flange being in alignment with one another to define an elongated slot-like space for receipt of a leg of a connector therewithin.

* * * * *